US005465571A

United States Patent [19]

Clark

[11] Patent Number: 5,465,571

[45] Date of Patent: Nov. 14, 1995

[54] FUEL NOZZLE ATTACHMENT IN GAS TURBINE COMBUSTORS

[75] Inventor: Jim A. Clark, Jupiter, Fla.

[73] Assignee: United Technologies Corporation, Hartford, Conn.

[21] Appl. No.: 171,362

[22] Filed: Dec. 21, 1993

[51] Int. Cl.[6] ..... F02C 7/22

[52] U.S. Cl. ..... 60/39.32; 60/740; 60/748

[58] Field of Search ..... 60/39.31, 39.32, 60/740, 748, 734, 751, 752

[56] References Cited

U.S. PATENT DOCUMENTS

| | | | |
|---|---|---|---|
| 3,032,990 | 5/1962 | Rogers | 60/39.32 |
| 4,441,323 | 4/1984 | Colley | 60/39.32 |
| 4,453,384 | 6/1984 | Pask | 60/748 |
| 5,020,329 | 6/1991 | Ekstedt | 60/39.32 |
| 5,333,459 | 8/1994 | Berger | 60/748 |

*Primary Examiner*—Louis J. Casaregola
*Attorney, Agent, or Firm*—Robert E. Greenstien

[57] ABSTRACT

In a gas turbine, a linear stem extends through a diffuser and a combustor cowl into a sleeve that is attached to the swirler in such a way that the sleeve can move relative to the swirler but is supported on the swirler. The stem slides into the sleeve and contains a fuel nozzle that supplies fuel through a sleeve outlet to a swirler inlet.

7 Claims, 4 Drawing Sheets

FUEL NOZZLE ATTACHMENT IN GAS TURBINE COMBUSTORS

TECHNICAL FIELD

This invention relates to gas turbine engines, particularly, techniques for attaching fuel nozzles in the combustors used in gas turbine engines.

BACKGROUND OF THE INVENTION

In a conventional gas turbine engine, fuel is supplied to the combustor through a nozzle that extends into a swifter. The combustor has a plurality of swirlers. Each swifter is attached to the combustor dome, and the nozzle is separated from the swifter by a bearing plate, a configuration that accommodates thermal growth between the nozzle and the swifter. Axial thermal growth is accommodated by the fit between the nozzle and the passage or bore, through which the nozzle extends in the swifter.

The nozzle is at the end of stem or fuel feed arm that extends through the diffuser case wall and the combustor cowl. The stem provides the only nozzle support and carries the fuel to the nozzle. This diffuser case wall also contains an airflow diffuser, which provides air both to the combustor for the combustion process and around the combustor for cooling. The outer wall has a port through which the stem extends and a flanged area to which the stem is attached, providing the only rigid connection between the nozzle and the combustor. The nozzle, located at the end of the support, typically extends rearward at something approaching a right angle to the support. Owing to the nozzle's extension through the bearing plate and the swifter, installing the nozzle involves some manual dexterity, besides imposing some limitation on the combustor's layout. Generally speaking, the nozzle is removed by moving the stem forward far enough that the nozzle (at the end of the stem) clears the bearing plate and the swifter. Then the stem is removed through an access hole in the diffuser case. Installation follows the reverse sequence. Usual practice is to have a prediffuser in front of the combustor, but it must not be so long that the nozzle cannot be installed or removed, a design factor that limits the effectiveness of the prediffuser.

Some combustor designs reduce the size and complexity of the stem, for instance, the configuration shown in U.S. Pat. No. 4,453,384, which uses a generally straight stem (fuel feed arm).

DISCLOSURE OF THE INVENTION

An object of the present invention is to provide an improved technique for mounting a nozzle in a combustor.

According to the present invention, the stem is a straight tube and the nozzle is flush with the tube's cylindrical surface. The tube slips into a sleeve that is attached to the swirler in such a way it can move radially and axially relative to the swirler.

According to the invention, the sleeve is tubular and at right angle to the swirler inlet orifice or passage. The perimeter of the swirler around the orifice is located (sandwiched) between a flange on the sleeve and the sleeve body.

A feature of the present invention is that the nozzle and stem can be withdrawn simply by withdrawing the tube from the sleeve. Another feature is that the distance between the trailing end of the prediffuser and the combustor can be reduced. Still another feature is that the holes in the diffuser case and the cowl for the stem are smaller, increasing component strength and reducing leakage.

Other objects, benefits and features of the invention will be apparent to one skilled in the art from the following description and the drawings.

DETAILED DESCRIPTION OF THE INVENTION

Figure 1:
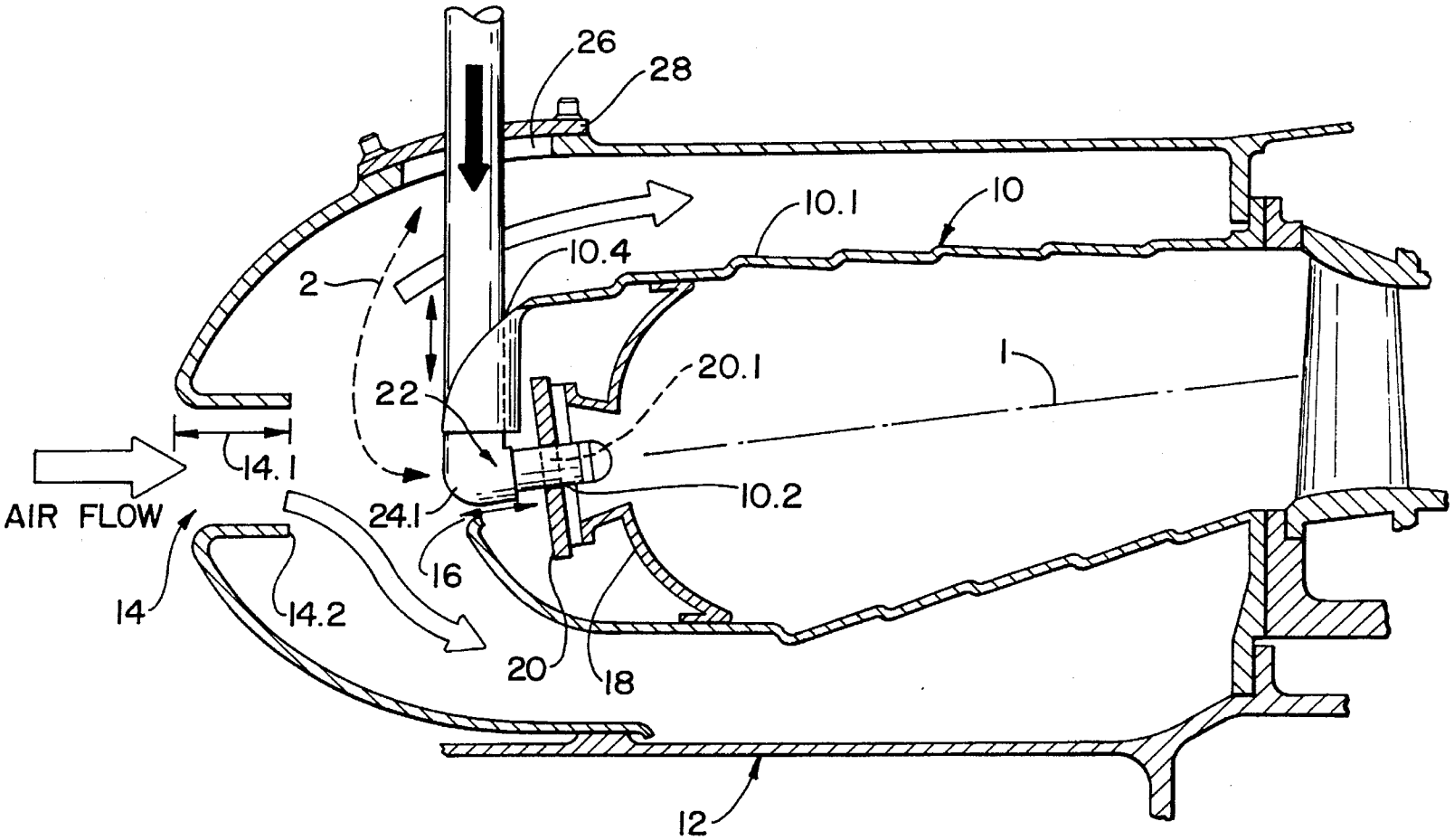
FIG. 1 (PRIOR ART)
FIG. 1 is a section of a typical prior art combustor.

Referring to FIG. 1, which shows a prior art combustor configuration, a combustor 10 is contained in a combustor housing or casing 12 (defining the "burner"). The forward end of the casing includes a prediffuser 14, which receives airflow, directing a portion around the combustor 12 and a portion to an air inlet 16. A swirler 18, attached to the interior of the combustor walls 10.1 in an area often called the dome, contains a orifice or passage 10.2, creating a swirler inlet. A bearing plate 20, upstream of the swirler 18, contains a similar orifice on the same axis (longitudinal combustor axis 1). A nozzle 22 protrudes through both orifices 10.2 and 20.1, in a close fit that allows the nozzle to move along the longitudinal axis 1 relative to the plate 20 and the swirler 10. The nozzle is actually at the end of a stem 24 that extends through hole 10.4 in the cowl and through an access hole 26 on the casing 12 that is surrounded by a boss 28. An attachment flange 30 is included on the stem 24 and is bolted to the boss 28 with fasteners of a suitable type (not shown). Other than this connection, the stem, more importantly, the nozzle otherwise is not rigidly attached to the casing (the burner). The stem 24 also serves as a fuel supply line to the nozzle 22.

The L-shaped end on 24. 1, on which the nozzle is attached, should be noticed because, when the nozzle is inserted or removed, the stem 24 must be rotated, so to speak, in the direction of the dotted line 2. For instance to remove the nozzle, e.g., for cleaning, the nozzle is first extracted from the orifices 10.1 and 20.1 and then is withdrawn through the access hole 26. This hole or port 26 must be large enough to receive the L-shaped portion 24.1, containing the nozzle, and permit the rotation of the stem along line 2 to withdraw (or insert) the stem into the swirler. Also, the size (line 14.1) of the prediffuser must provide sufficient distance between the prediffuser trailing edge 14.2 and the L-shaped portion 24.1 for the motion along line 2.

Figure 2:
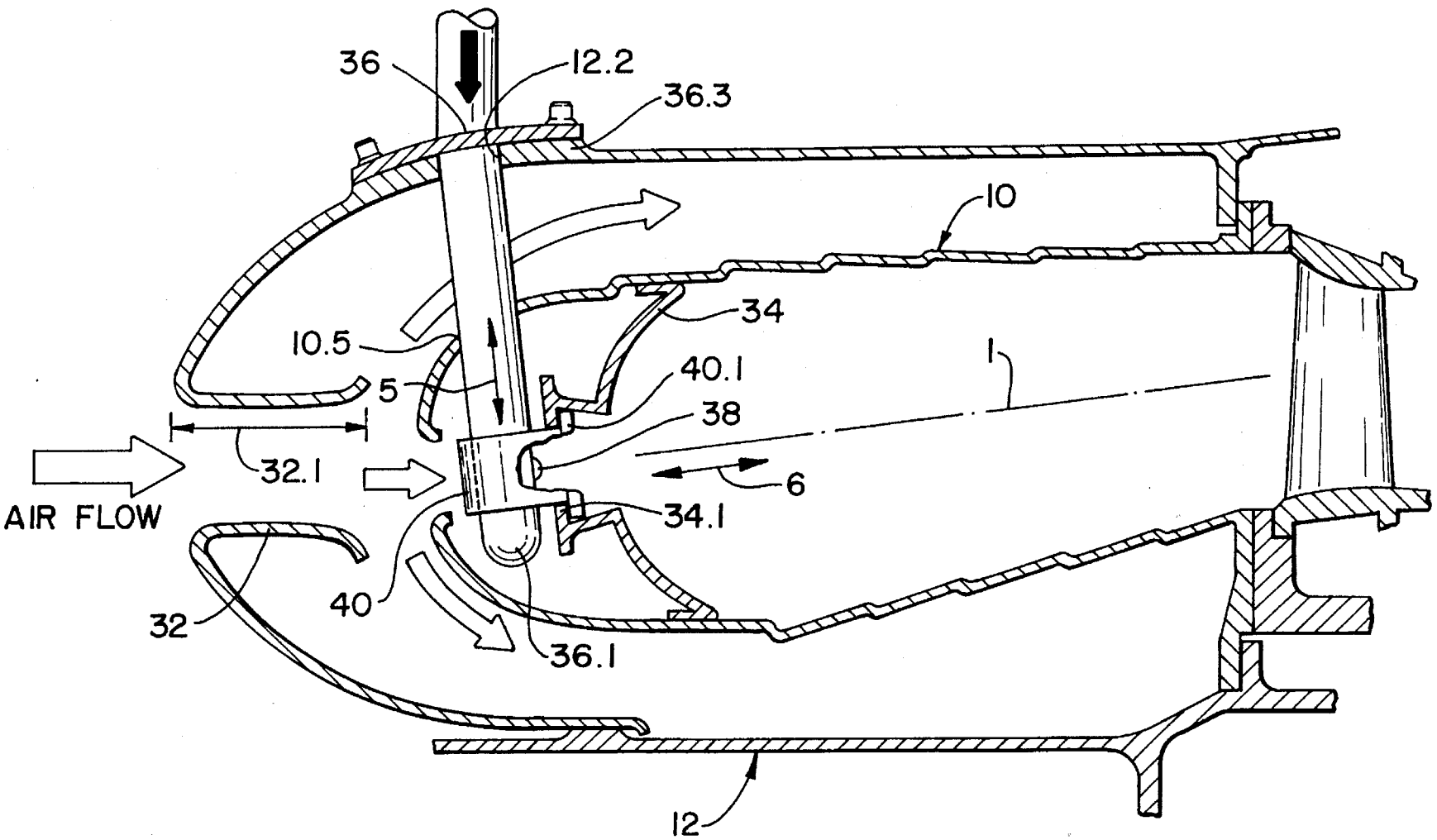
FIG. 2 is a section of a combustor embodying the present invention.
Figure 3:
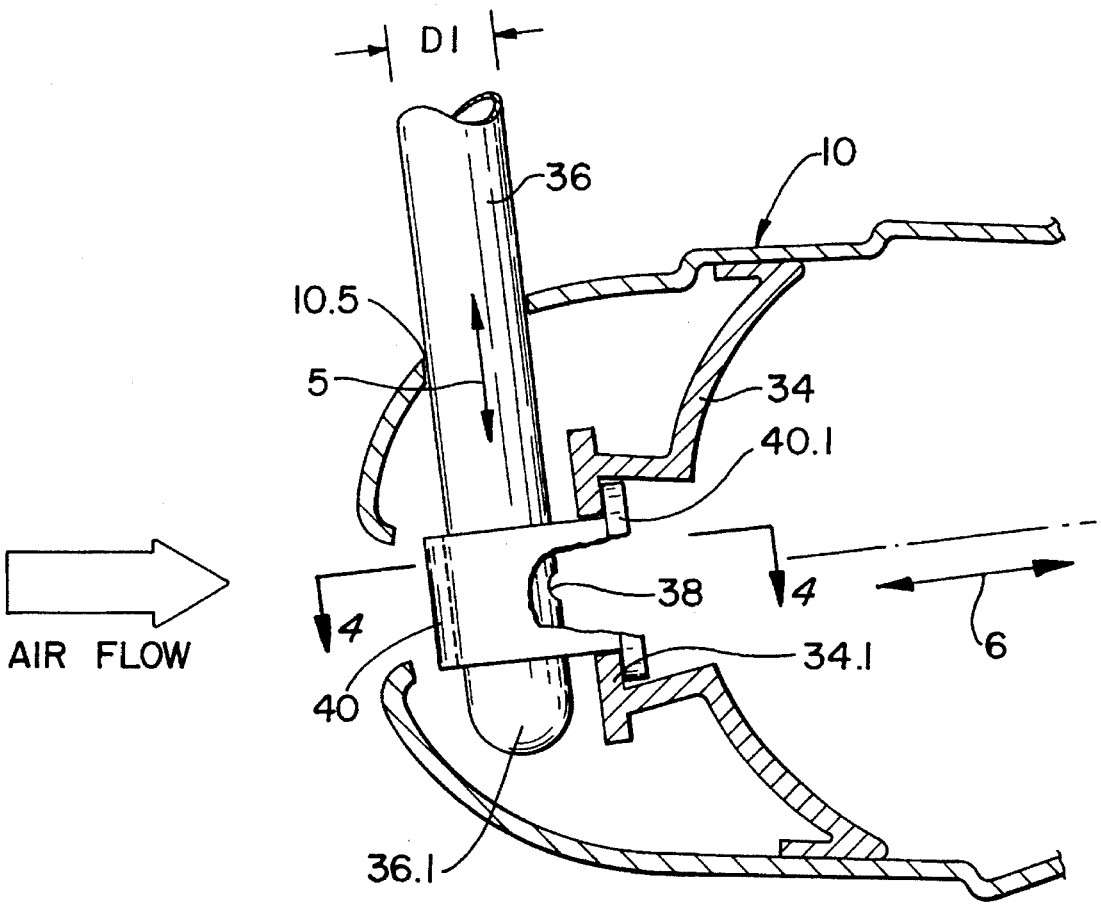
FIG. 3 is magnified view of the fuel nozzle and swirler in FIG. 2.
Figure 4:
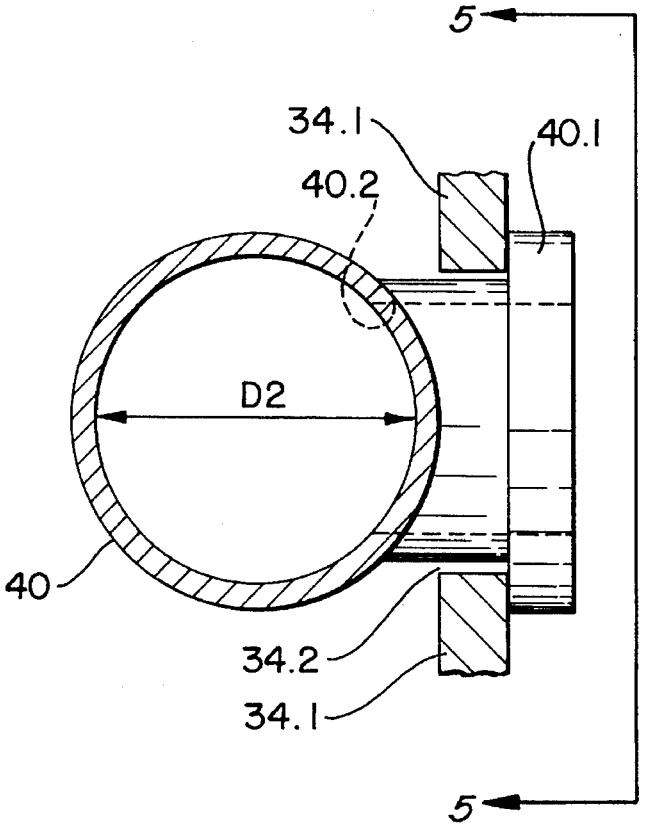
FIG. 4 is a section along line 4—4 in FIG. 3, when the nozzle is removed.
Figure 5:
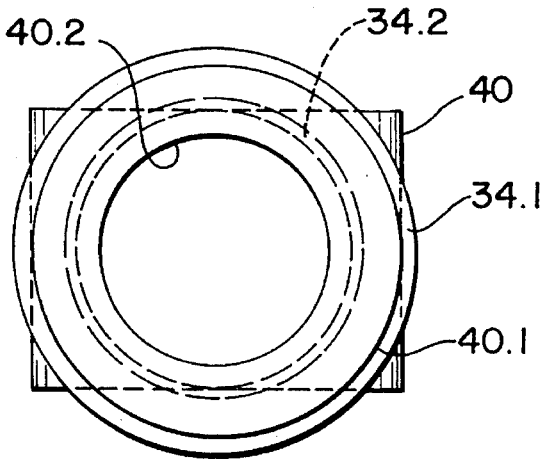
FIG. 5 is a view along line 5—5 in FIG. 4.

Turning now to FIG. 2, which shows an embodiment of the invention, again the combustor 10 and case 12 are provided, along with a prediffuser 32. Here, however, a stem 36 for the nozzle is simply a straight tube with a fuel nozzle 38 near the bottom end 36.1. The bottom end passes through a sleeve 40 that contains a flange 40.1. A flange-like portion 34.1 of the swirler is captured between this flange and the sleeve 40. That portion 34.2 (see FIGS. 4 and 5) surrounds an orifice or passage, comparable to the passage 10.2, for fuel discharge from the nozzle 38 into the swirler. The outer diameter D1, for the stem 36, is the same as the inner diameter D2 for the sleeve 40, providing a tight fit, yet one that permits the stem to slide up and down in the direction of arrow 5 in FIG. 3. Axial movement, line 6 in FIG. 3, is accommodated by the flange or collar 40.1 and the surface 34.1. Likewise, thermal growth (line 5) of the swirler relative to the cooler sleeve (due to fuel flow) is accommodated in the same way between the flange 40.1 and the surface 34.1. The sleeve 40 contains a opening, shown generally as 40.2 for fuel from the nozzle 38, which in this example is flush with the tube surface. Other configurations are possible. For instance, the nozzle could be nib and the sleeve could contain a slot (vertical in FIG. 3 ) for the nib.

Insertion and removal of the nozzle is simple. A flange 36.3, welded to the stem 36, is unbolted from the casing 10. Then, the stem 36 is withdrawn radially through the hole 12.1, eliminating any need for the rotation along line 2 required in the configuration shown FIG. 1. From this it can be appreciated that the length 32.1 of the prediffuser 32 may be considerably longer than the length 14.1 in the prior art configuration shown in FIG. 1. Furthermore, the hole 12.2 in FIG. 2, can be considerably smaller than the hole 12.2 in FIG. 1, increasing the strength of the case 12, besides reducing the size of the stem's flange 36.3. Likewise, because the stem is straight, the hole 10.5 in the combustor cowl (forward of the dome) is smaller than the hole 10.4 in FIG. 1. The stem fits tightly in the hole 10.5, significantly reducing the potential for leakage from the interior of the combustor cowl.

With the benefit of the foregoing explanation of the invention, one skilled in the art may find it possible to make modifications to the invention, in whole or in part, in addition any described or suggested previously, without departing from the true scope and spirit of the invention.

I claim:

1. A gas turbine comprising a diffuser surrounding a combustor cowl and a fuel nozzle and swirler inside the cowl, characterized by:

a sleeve with a sleeve outlet opposite the swirler inlet and containing a sleeve flange on the periphery of the sleeve outlet, the sleeve flange extending radially normal to the axis of the swirler;

the swirler having a swirler surface around the swirler inlet and on a plane that is normal to the swirler axis, the swirler surface being located between the sleeve flange and the sleeve; and a linear stem that extends from a location outside the diffuser through the diffuser and the cowl into the sleeve, the outer surface of the stem being received by the inner surface of the sleeve and containing the fuel nozzle, the fuel nozzle facing the sleeve outlet.

2. The gas turbine described in claim 1, further characterized in that:

the stem has a uniform circular cross-section and the sleeve has a circular cross-section.

3. The gas turbine described in claim 2, further characterized in that an outer surface of the stem slides on an inner of the sleeve.

4. A gas turbine comprising a diffuser surrounding a combustor cowl and a fuel nozzle and a swirler inside the cowl, characterized by:

a sleeve with a sleeve outlet opposite a swirler inlet and mounted on the swirler for restricted movement normal to and along a swirler axis normal to the plane of the swirler inlet;

the swirler having a swirler surface defined by the swirler inlet, the swirler surface engaging the sleeve around the sleeve outlet to provide the restricted movement; and a linear stem that extends from a location outside the diffuser through the diffuser and the cowl into the sleeve, the outer surface of the stem being received by the inner surface of the sleeve and containing the fuel nozzle, the fuel nozzle facing the sleeve outlet.

5. A method of assembly for a gas turbine combustor characterized by the steps:

installing a sleeve on a swirler with the sleeve capturing a portion of the swirler to limit sleeve movement normal to the plane of the swirler and permit sleeve movement parallel to said plane;

placing a linear stem through a diffuser housing and a combustor dome into the sleeve, the inner surface of the sleeve receiving the outer surface of the stem; and installing a fuel supply nozzle on the stem at location facing a sleeve outlet leading to a swirler inlet.

6. The method described in claim 5, further characterized by the steps:

placing a sleeve flange around the sleeve outlet, and installing the sleeve with a swirler flange between the sleeve flange and the sleeve.

7. A gas turbine comprising a combustor cowl, a swirler attached to the cowl, and a diffuser containing the combustor cowl and the swirler, characterized by:

a stem for supplying fuel to the swirler and for containing a nozzle at one end, the stem extending in a linear path through the diffuser and the cowl; and means for supporting an end of the stem on the swirler, for permitting the stem the slide a selected distance within said means normal to an axis extending through an fuel inlet on the swirler, for permitting the stem and said means to slide a selected distance in the direction of said axis, and for providing access to the swirler inlet from said one end of the stem for said nozzle at one end of the stem.

* * * * *